US008793821B2

(12) United States Patent
Fowkes et al.

(10) Patent No.: US 8,793,821 B2
(45) Date of Patent: Aug. 5, 2014

(54) CUSHION WITH DOUBLE STACKED OFF-SET HONEYCOMB

(75) Inventors: Doug Fowkes, Provo, UT (US); John Omdahl, Lindon, UT (US); Mark Schulte, Orem, UT (US); Tyler Allan, Springville, UT (US); Michael Horito, Provo, UT (US)

(73) Assignee: Doug Fowkes, Provo, UT (US)

( * ) Notice: Subject to any disclaimer, the term of this patent is extended or adjusted under 35 U.S.C. 154(b) by 1021 days.

(21) Appl. No.: 12/834,550

(22) Filed: Jul. 12, 2010

(65) Prior Publication Data

US 2012/0005821 A1 Jan. 12, 2012

(51) Int. Cl.
*A47K 3/12* (2006.01)

(52) U.S. Cl.
USPC ..... 4/579; 4/578.1; 5/654

(58) Field of Classification Search
USPC ..... 4/571.1, 573.1, 575.1, 578.1, 579, 580; 5/654, 900, 655.9
See application file for complete search history.

(56) References Cited

U.S. PATENT DOCUMENTS

| | | | |
|---|---|---|---|
| 2,541,029 | A | 2/1951 | Burton |
| 2,582,439 | A | 1/1952 | Kavanagh |
| D174,812 | S | 5/1955 | Haller |
| 2,751,609 | A | 6/1956 | Oesterling et al. |
| 2,785,739 | A | 3/1957 | McGregor et al. |
| 3,462,776 | A | 8/1969 | Cox |
| 4,037,591 | A | 7/1977 | Sarno |
| 4,111,585 | A | 9/1978 | Mascaro |
| 4,155,211 | A | 5/1979 | Saylor et al. |
| 4,422,194 | A | 12/1983 | Viesturs et al. |
| 4,512,044 | A | 4/1985 | Clark |
| 4,630,323 | A | 12/1986 | Sage et al. |
| 4,636,444 | A | 1/1987 | Lombardozzi |
| 4,673,452 | A | 6/1987 | Awdhan |
| D290,916 | S | 7/1987 | Madison et al. |
| 4,686,724 | A | 8/1987 | Bedford |
| 4,768,251 | A | 9/1988 | Baskent |
| 4,819,287 | A | 4/1989 | Halverson |
| 4,825,488 | A | 5/1989 | Bedford |
| 4,901,387 | A | 2/1990 | Luke |
| D310,610 | S | 9/1990 | Dixon |
| 4,988,234 | A | 1/1991 | Henkel et al. |
| D325,842 | S | 5/1992 | Bied |
| 5,111,542 | A | 5/1992 | Farley |
| 5,123,132 | A | 6/1992 | Dixon |
| 5,134,735 | A | 8/1992 | Rose |

(Continued)

OTHER PUBLICATIONS

U.S. Appl. No. 12/688,359, filed Jan. 15, 2010; Doug Fowkes; Notice of Allowance issued Jul. 5, 2011.

(Continued)

*Primary Examiner* — Gregory Huson
*Assistant Examiner* — Janie Christiansen
(74) *Attorney, Agent, or Firm* — Thorpe North & Western LLP

(57) ABSTRACT

A cushion or bathtub mat includes a pair of contiguous layers each with a repeating pattern of upstanding straight walls forming upstanding cells with upstanding openings between the walls. The repeating patterns of the pair of layers are laterally offset with respect to one another to form a dual layer offset honeycomb. The walls are flexible to buckle into the openings of the cells under a compressive force, and resilient to return to an original upstanding orientation, while having at least a strength to be self-supporting.

20 Claims, 8 Drawing Sheets

(56) References Cited

U.S. PATENT DOCUMENTS

| | | | | |
|---|---|---|---|---|
| 5,160,785 | A | 11/1992 | Davidson, Jr. | |
| D335,036 | S | 4/1993 | Simmons | |
| D337,913 | S | 8/1993 | Rose | |
| 5,327,597 | A | 7/1994 | Rothbard | |
| 5,353,455 | A | 10/1994 | Loving et al. | |
| 5,460,865 | A | 10/1995 | Tsotsis | |
| D365,956 | S | 1/1996 | Bonaddio et al. | |
| 5,518,802 | A | 5/1996 | Colvin et al. | |
| 5,535,458 | A | 7/1996 | Siverly | |
| D374,367 | S | 10/1996 | Bonaddio et al. | |
| D375,863 | S | 11/1996 | Bigolin | |
| 5,617,595 | A | 4/1997 | Landi et al. | |
| D383,253 | S | 9/1997 | Semenuk | |
| D390,401 | S | 2/1998 | Pirraglia et al. | |
| D390,402 | S | 2/1998 | Pirraglia et al. | |
| D390,403 | S | 2/1998 | Pirraglia et al. | |
| D391,434 | S | 3/1998 | Denney et al. | |
| D394,578 | S | 5/1998 | Raburn | |
| 5,749,111 | A | 5/1998 | Pearce | |
| 5,804,030 | A | 9/1998 | Jaegers et al. | |
| 5,879,780 | A | 3/1999 | Kindinger et al. | |
| 5,888,613 | A | 3/1999 | Ketcham et al. | |
| 5,978,980 | A | 11/1999 | Flora | |
| D417,354 | S | 12/1999 | Valenti | |
| 6,026,527 | A | 2/2000 | Pearce | |
| D423,123 | S | 4/2000 | Sassenberg | |
| 6,068,332 | A | 5/2000 | Faust et al. | |
| 6,079,366 | A | 6/2000 | Telleen | |
| D429,437 | S | 8/2000 | Valenti | |
| D429,590 | S | 8/2000 | Wallace | |
| D435,186 | S | 12/2000 | Fulkerson | |
| D444,550 | S | 7/2001 | Cobbs | |
| 6,357,061 | B1 | 3/2002 | Gonzalez | |
| 6,387,013 | B1 | 5/2002 | Marquez | |
| D458,502 | S | 6/2002 | Caban | |
| 6,413,458 | B1 * | 7/2002 | Pearce | 264/141 |
| 6,453,485 | B2 | 9/2002 | Bullock | |
| D469,815 | S | 2/2003 | Wells et al. | |
| D478,452 | S | 8/2003 | Kafka et al. | |
| 6,663,537 | B2 | 12/2003 | McCoy | |
| 6,677,026 | B1 | 1/2004 | Yates | |
| 6,681,416 | B1 | 1/2004 | Yang | |
| D486,343 | S | 2/2004 | Feuer | |
| 6,701,557 | B2 | 3/2004 | Barman | |
| 6,739,104 | B2 | 5/2004 | Tokonabe et al. | |
| 6,767,606 | B2 | 7/2004 | Jackson et al. | |
| D494,402 | S | 8/2004 | Scansetti | |
| D506,098 | S | 6/2005 | Martin et al. | |
| 6,969,548 | B1 | 11/2005 | Goldfine | |
| 7,024,714 | B1 | 4/2006 | Yates | |
| 7,060,213 | B2 | 6/2006 | Pearce | |
| D524,585 | S | 7/2006 | Contreras | |
| D527,564 | S | 9/2006 | Contreras | |
| D528,340 | S | 9/2006 | Contreras | |
| D543,405 | S | 5/2007 | Fowkes | |
| D552,268 | S | 10/2007 | Bozouklian et al. | |
| D593,220 | S | 5/2009 | Reed | |
| 7,661,164 | B2 | 2/2010 | Chen | |
| 7,665,159 | B2 | 2/2010 | Fowkes | |
| 7,716,766 | B2 | 5/2010 | Poulos | |
| 7,886,388 | B2 | 2/2011 | Warren et al. | |
| 8,037,555 | B2 | 10/2011 | Fowkes | |
| 8,042,201 | B2 | 10/2011 | Brooks | |
| D653,893 | S | 2/2012 | Huss et al. | |
| 8,359,689 | B2 | 1/2013 | Warren et al. | |
| D692,622 | S | 10/2013 | MacKenney | |
| 2003/0131407 | A1 | 7/2003 | Gutierrez et al. | |
| 2005/0108968 | A1 | 5/2005 | Forster | |

OTHER PUBLICATIONS

U.S. Appl. No. 29/366,265, filed Jul. 22, 2010; Doug Fowkes; office action dated Oct. 18, 2012.
U.S. Appl. No. 12/688,359, filed Jan. 15, 2010; Doug Fowkes; Office Action issued Mar. 30, 2011.
U.S. Appl. No. 12/709,922, filed Feb. 22, 2010; Doug Fowkes; office action dated Apr. 10, 2013.
Fowkes, U.S. App. No. 12/688,359, filed Jan. 5, 2010.
Fowkes, U.S. Appl. No. 29/366,265, filed Jul. 22, 2010.
Fowkes, U.S. Appl. No. 12/709,922, filed Feb. 22, 2010.
PCT Application PCT/US2011/043000; filing date Jul. 6, 2011; Doug Fowkes; International Search Report mailed Mar. 16, 2012.
U.S. Appl. No. 29/366,265; filed Jul. 22, 2010; Doug Fowkes; office action dated Mar. 27, 2014.

* cited by examiner

CUSHION WITH DOUBLE STACKED OFF-SET HONEYCOMB

RELATED APPLICATIONS

This is related to U.S. Pat. No. 7,665,159, issued Feb. 23, 2010; U.S. Design Pat. No. D543,405, issued May 29, 2007; U.S. patent application Ser. No. 12/688,359, filed Jan. 15, 2010; and U.S. patent application Ser. No. 12/709,922, filed Feb. 22, 2010; all of which are herein incorporated by reference in their entirety.

BACKGROUND

1. Field of the Invention

The present invention relates generally to cushion structures.

2. Related Art

A cushion of parallel columns formed of a gelatinous elastomer has been proposed and sold as Intelli-Gel® and Ortho-Gel™. See also U.S. Pat. Nos. 5,749,111; 6,413,458; 6,026,527; 7,060,213 and 7,060,213.

SUMMARY OF THE INVENTION

It has been recognized that it would be advantageous to develop a cushion. In addition, it has been recognized that it would be advantageous to develop a cushion for use in a bathtub.

The invention provides a cushion device including a pair of contiguous layers each with a repeating pattern of upstanding straight walls forming upstanding cells with upstanding openings between the walls. The repeating patterns of the pair of layers are laterally offset with respect to one another. The walls are flexible to buckle into the openings of the cells under a compressive force and resilient to return to an original upstanding orientation, the walls having at least a strength to be self-supporting

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Definitions

The term "straight" is used herein to refer to essentially straight although a slight amount of taper may exist, such as to allow removal of a part from a mold in an injection molding process.

The term "upstanding" is used herein to refer to a straight and/or upright and/or aligned or inline configuration and/or straight orientation aligned or extending perpendicularly between opposite ends (such as top and bottom of the layers), regardless of particular orientation, such as vertical or horizontal.

The term "contiguous" is used herein to refer to elements that are bordering one another.

The phrase "laterally off-set" is used herein to refer to two patterns that are not aligned with each other, and that can be off-set in one dimension or two dimensions.

The terms "bottom" and "top" are used herein with respect to one another or in relationship to one another. It is to be understood that such terms are not intended to limit the present invention but are used to aid in describing the components of the present invention. For example, one skilled in the relevant art would readily appreciate that a top and bottom layers when the mat or cushion is turned on its side would still constitute top and bottom layers, despite the lateral orientation.

DESCRIPTIONS

As illustrated in FIGS. 1-17, a cushion or portion thereof, indicated generally at 10, in an example implementation in accordance with the invention is shown. The cushion or cushion portion 10 can be part of a larger cushion or mat, such as a bathtub mat 8 as shown in FIG. 14. Such a bathtub mat can be used in a bathtub filled with water to provide a cushioned surface for a more comfortable and/or prolonged bathing experience with the user or bather laying on or recumbent on the mat. The cushion 10 or mat 8 can be flexible to contour to a bottom and/or sidewall of the bathtub. The cushion or mat is shown and described in a flat configuration to facilitate description. But it will be appreciated that the mat or cushion can be flexible to contour to or match a support surface, such as a bathtub. The cushion has or is a dual layer offset honeycomb formed of an elastomer gel so that walls of the honeycomb are flexible to buckle into openings of cells under a compressive force, and resilient to return to an original upstanding orientation. The elastomer gel can be water proof or water resistant. The cushion 10 can provide a cushion in water or in a bath without retaining water and/or floating.

Figure 12:
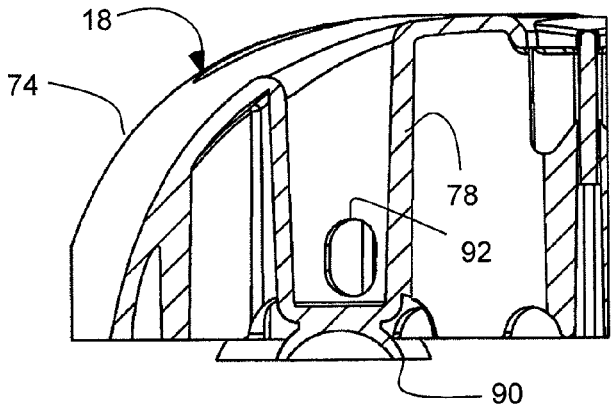
FIG. 12 is a partial detailed cross-sectional side view of the portion of the cushion of FIG. 1.

The cushion 10 or mat 8 can be laid flat in a layer and can include one or more interior portions 14 surrounded by a perimeter portion 18 that can extend partially or entirely around the interior portion. In addition, the cushion or mat can have a plurality of interior portions separated by interior partitions similar to the perimeter, as shown in FIG. 12 and described in greater detail below. The perimeter can be different than the interior portion.

The interior portion 14 of the cushion 10 can include three layers, including 1) a lower layer 22, 2) an intermediate layer 26 contiguous the lower layer, and 3) a third or top layer 30 contiguous with the intermediate layer and opposite the lower layer. The lower layer can form a lowermost layer of the cushion or mat which comes into direct contact or abuts to a support surface; while the upper layer can form an uppermost layer of the cushion which comes into direct contact with a user. The lower and intermediate layers 22 and 26 form a pair of contiguous layers. Each of the pair of layers 22 and 26 has a repeating pattern formed of upstanding straight walls 34. The walls form upstanding cells 38 with upstanding openings 42 between the walls. The cells 38 in each layer can be interconnected cells with adjacent cells sharing a common wall therebetween. The walls form the openings that can be hollow columns or shafts. The walls 34, the cells and the openings 42 can have a common orientation, or can be aligned, so that they are upright, or extending linearly with respect to the bottom and the top of the cushion or mat. The orientation of the walls can be perpendicular with respect to the layers. The repeating pattern can be a honeycomb with the walls 34 being straight or linear in an upright direction extending between a top and bottom of the cushion. In addition, the walls 34 can be straight or linear in a lateral direction.

Figure 3:
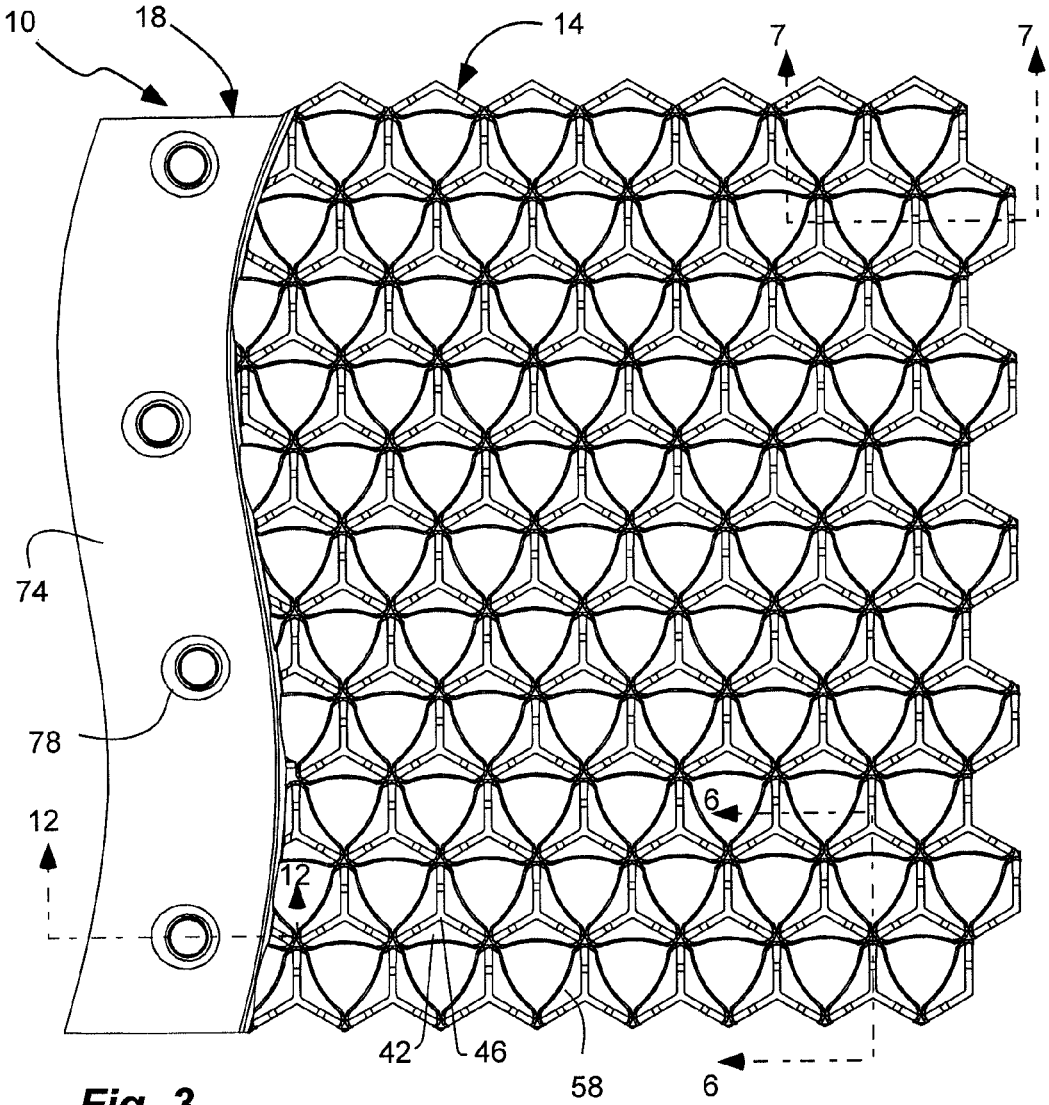
FIG. 3 is a top view of the portion of the cushion of FIG. 1.
Figure 5:
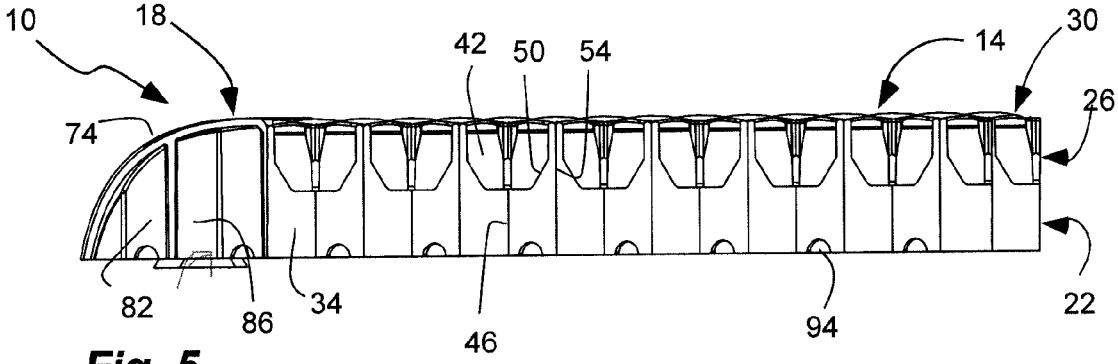
FIG. 5 is a side view of the portion of the cushion of FIG. 1.
Figure 4:
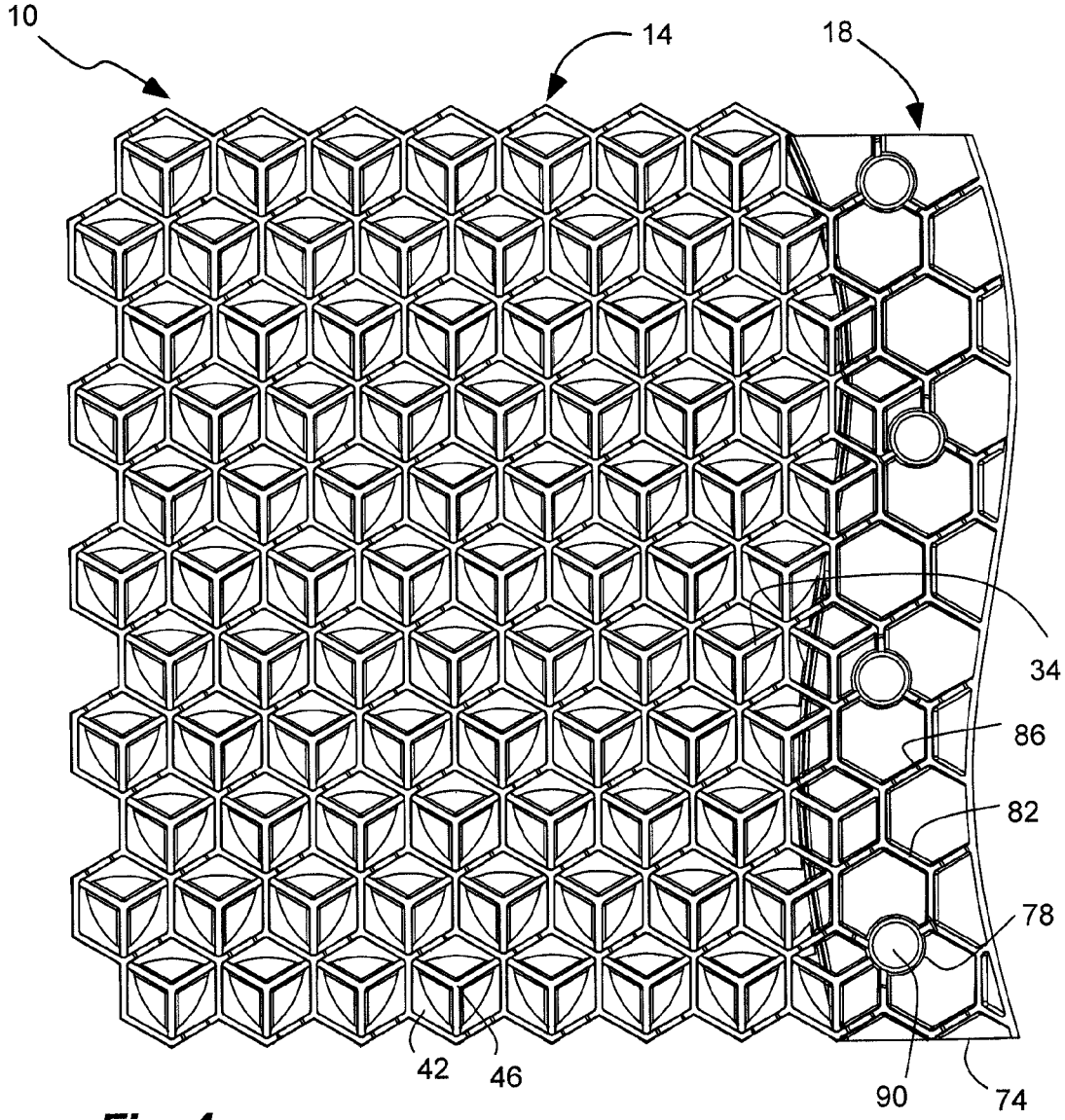
FIG. 4 is a bottom view of the portion of the cushion of FIG. 1.
Figure 8:
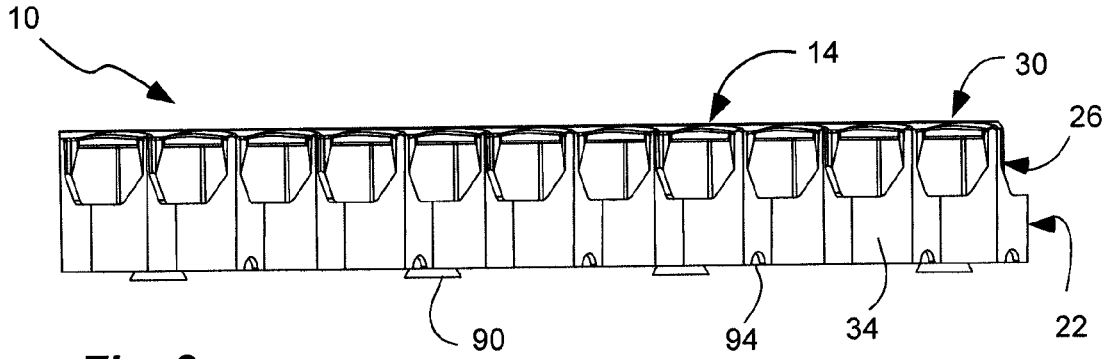
FIG. 8 is another side view of the portion of the cushion of FIG. 1.
Figure 9:
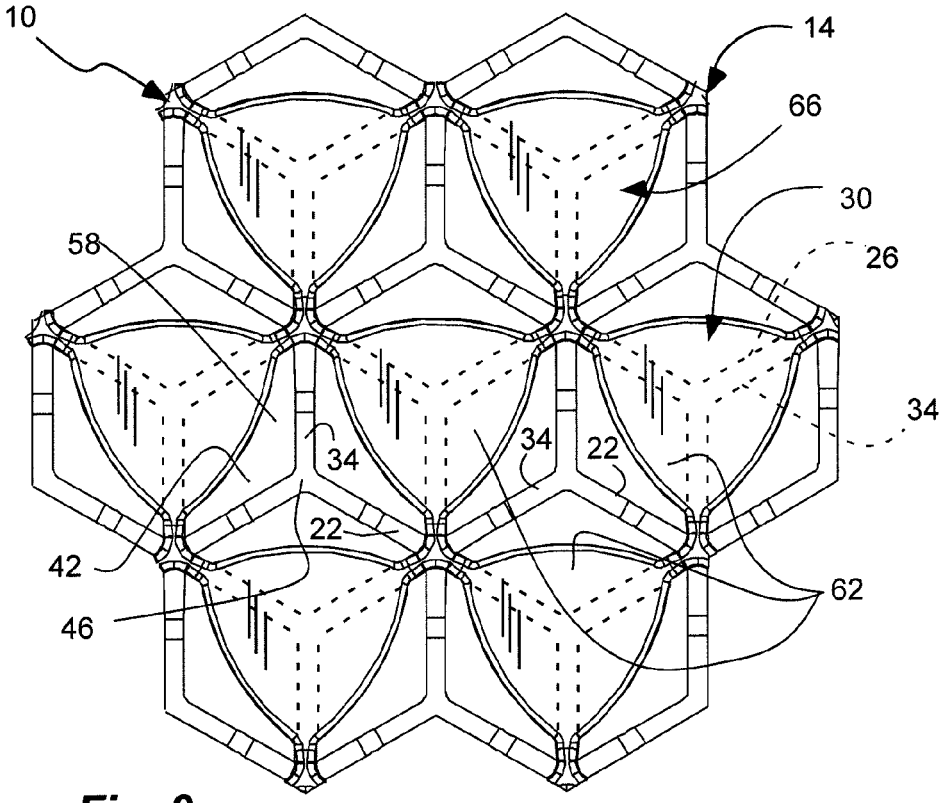
FIG. 9 is a partial detailed top view of the cushion of FIG. 1.
Figure 10:
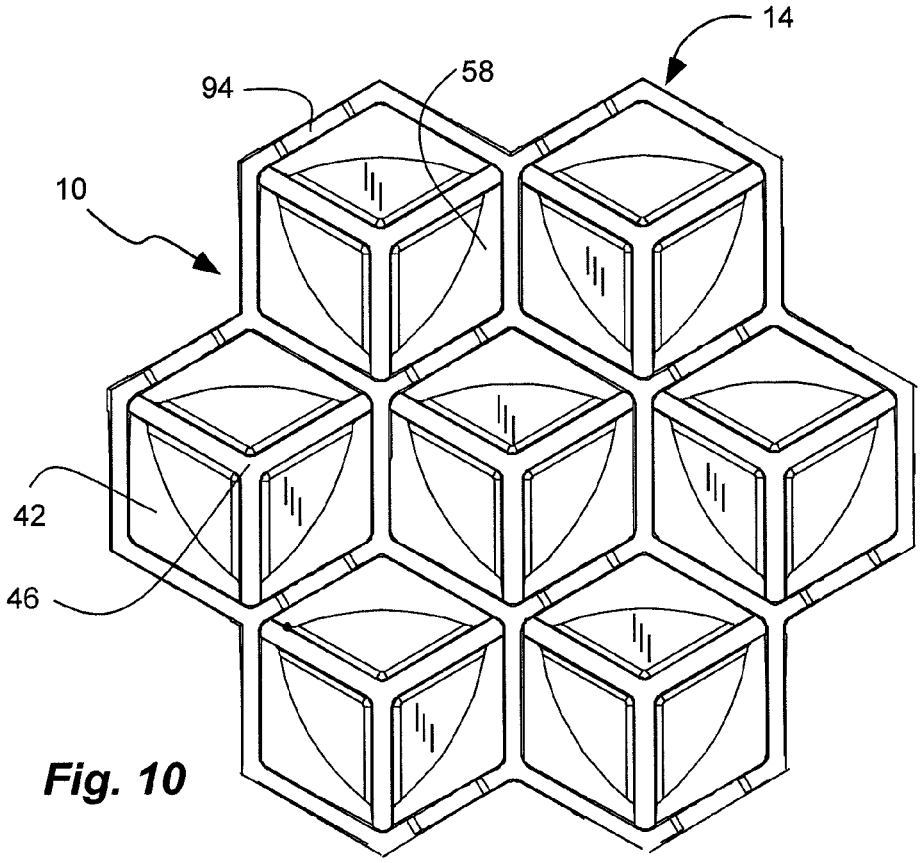
FIG. 10 is a partial detailed bottom view of the cushion of FIG. 1.

The repeating patterns of the pair of layers 22 and 26 are laterally offset with respect to one another, as shown in FIGS. 3 and 4. In addition, the walls 34, the cells 38 and the openings 42 of one layer 22 are commonly oriented with respect to the walls, the cells and the openings of the other layer 26. Thus, while the structures of the layers have a common orientation, they are not aligned or collinear. Thus, the patterns intersect one another. The layers can be off-set in laterally with respect to one another in two directions or dimensions. For example, some of the intersections 46 of the walls of one layer 22 are aligned with the openings 42 in the other layer 26, as shown in FIGS. 3 and 9, and visa versa, as shown in FIGS. 4 and 10. The pair of layers can be disposed directly on top of one another with the walls, or portions thereof, of one layer terminating as the walls, or portions thereof, of another layer begin. The pair of layers can have substantially equal or the same thickness or height. The openings 42 in the pair of layers can be open with respect to each other to form common openings continuous through the pair of layers.

Figure 1:
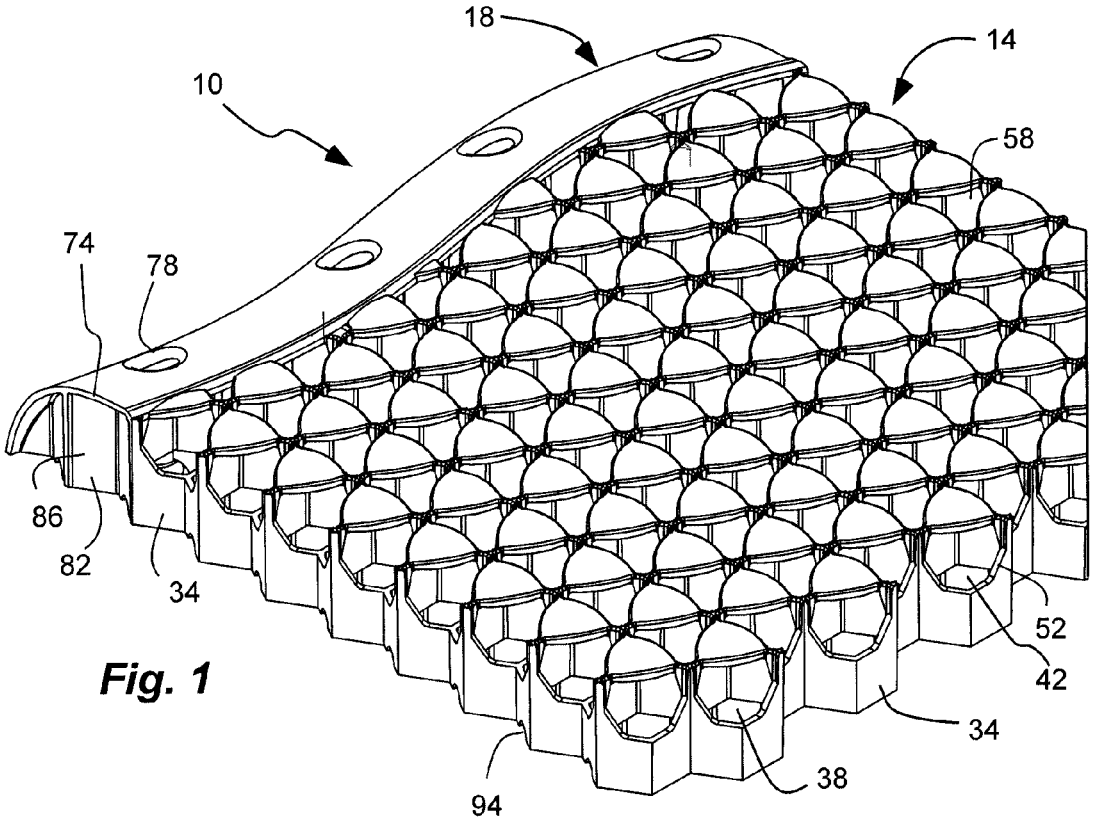
FIG. 1 is a top perspective view of a portion of a cushion in accordance with an embodiment of the present invention.
Figure 6:
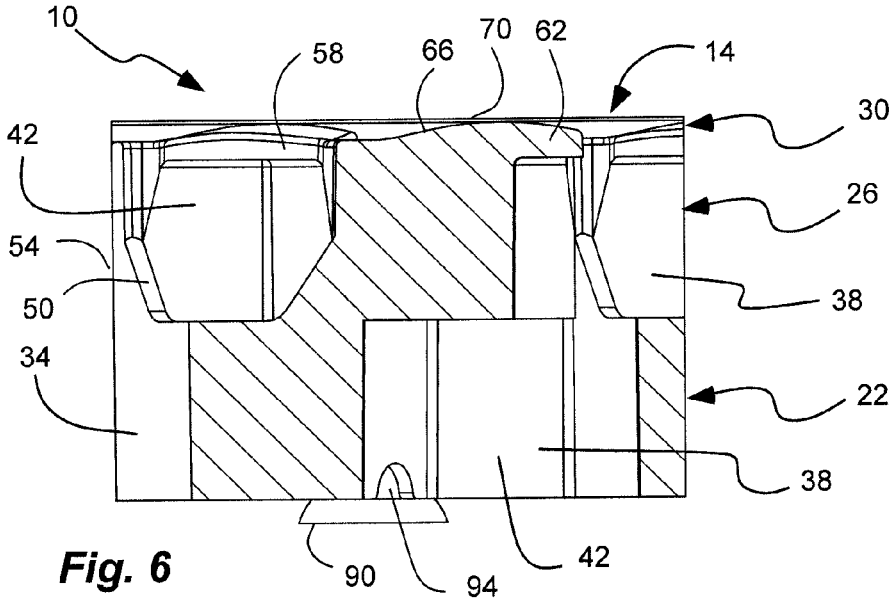
FIG. 6 is a cross-sectional side view of the portion of the cushion of FIG. 1.
Figure 2:
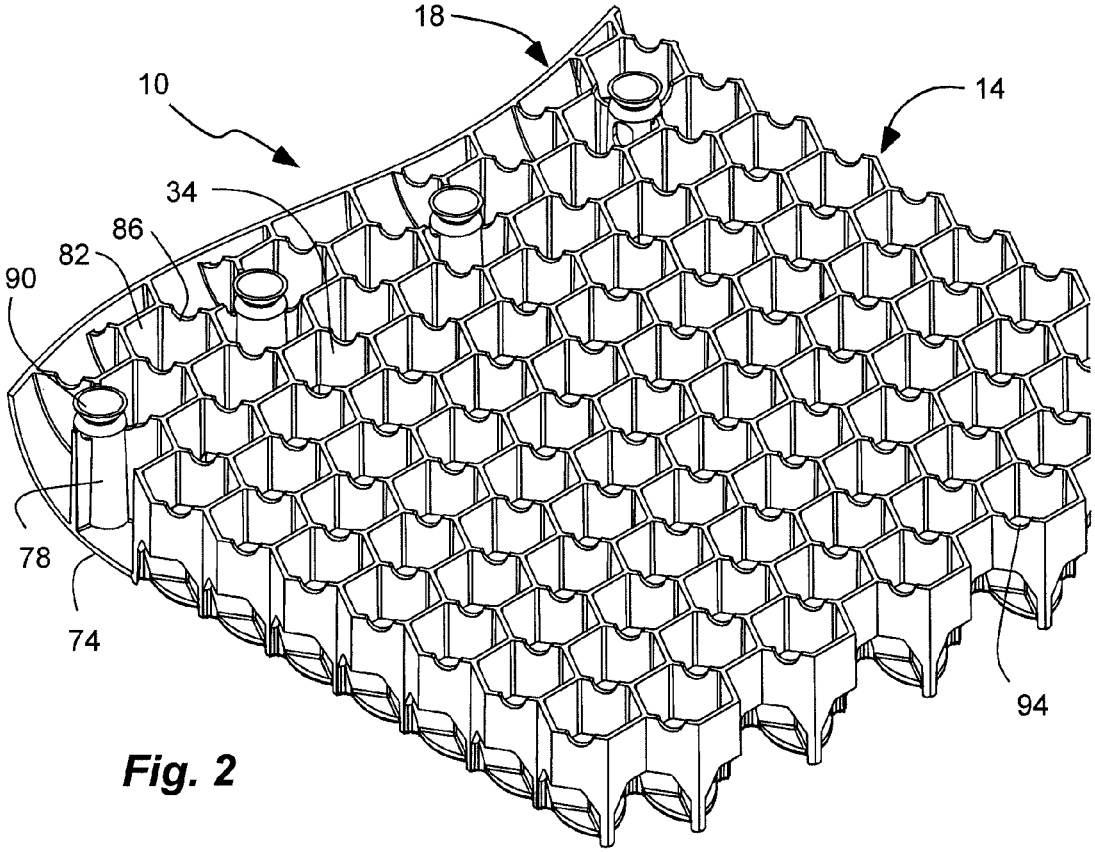
FIG. 2 is a bottom perspective view of the portion of the cushion of FIG. 1.
Figure 7:
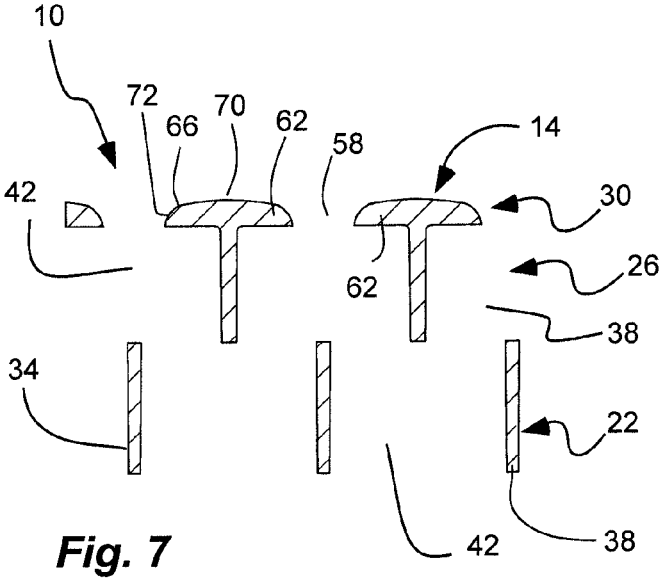
FIG. 7 is a cross-sectional side view of the portion of the cushion of FIG. 1.
Figure 11:
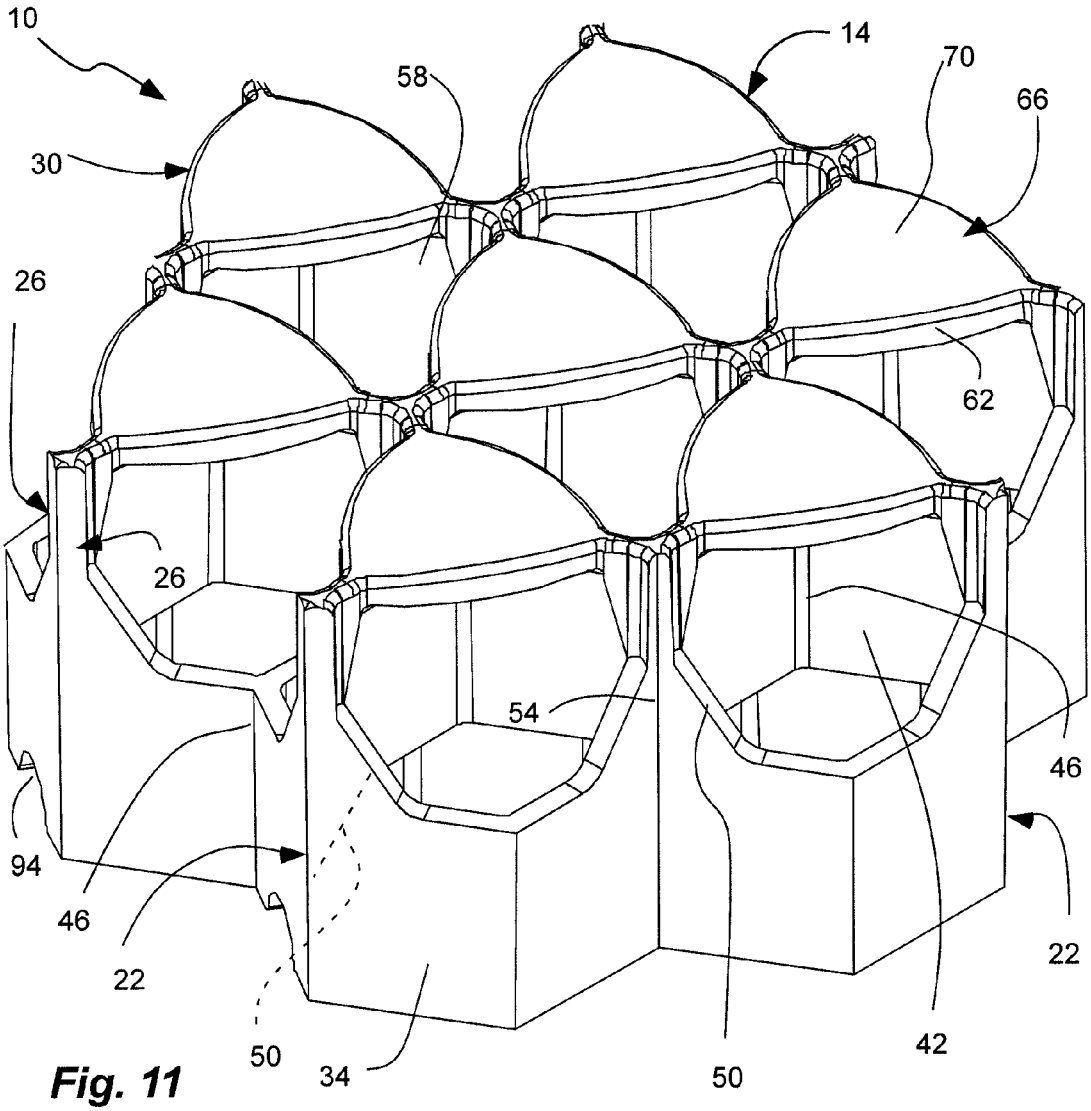
FIG. 11 is a partial detailed perspective view of the cushion of FIG. 1.

The walls 34, or portions thereof, of one 22 of the pair of layers can extend into the openings 42 of the cells of the other 26 of the pair of layers. An extending portion 50 of the walls 34 in one layer 22 can extend into the openings 42 of the other layer 26, as shown in FIGS. 6 and 11 (and visa versa as shown in the dashed line in FIG. 11). The extending portions 50 can be formed at intersections 54 of the walls. Thus, some of the intersections 46 of the walls in one layer terminate at the other layer, while some of the intersections 54 have the extending portions 50. In addition, some of the intersections 54 of one layer 22 can correspond or align with the intersections 54 of the other layer 26 to form a common intersection or wall section that extends between the two layers.

The repeating pattern of upstanding walls 34 can form a honeycomb pattern. The honeycomb pattern can be formed of hexagonal cells or openings 42 with six sides or walls 34. The pair of layers 22 and 26 or patterns thereof can form a dual layer offset honeycomb. It will be appreciated that the repeating pattern can have other shapes, including for example, square, rectangular, triangle, hexagon, octagon, circular, wavy, and combinations thereof. In addition, it will be appreciated that the patterns of the pair of layers 22 and 26 can be offset in one direction, as opposed to two, and can be offset asymmetrically.

Figure 15:
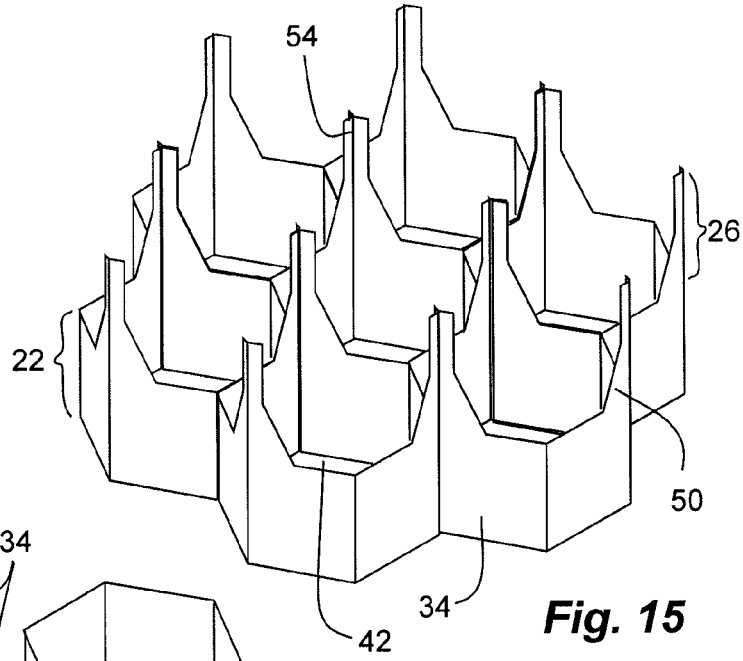
FIG. 15 is a partial perspective schematic view of the portion of the cushion of FIG. 1 with walls and cells of a lower layer shown with various walls and cells of an intermediate layer removed.
Figure 17:
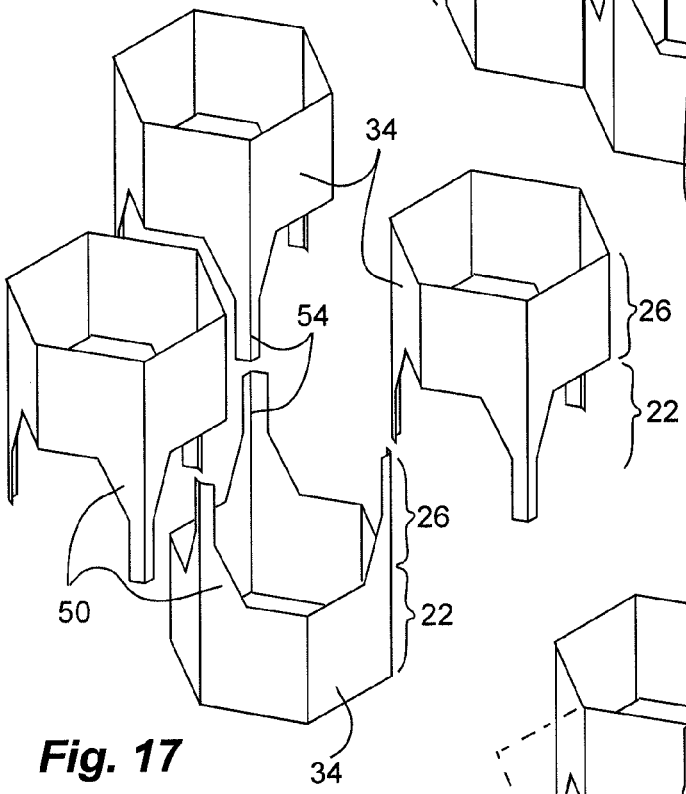
FIG. 17 is an exploded perspective schematic view of the portion of the cushion of FIG. 1 showing select walls and cells with various walls and cells removed.
Figure 16:
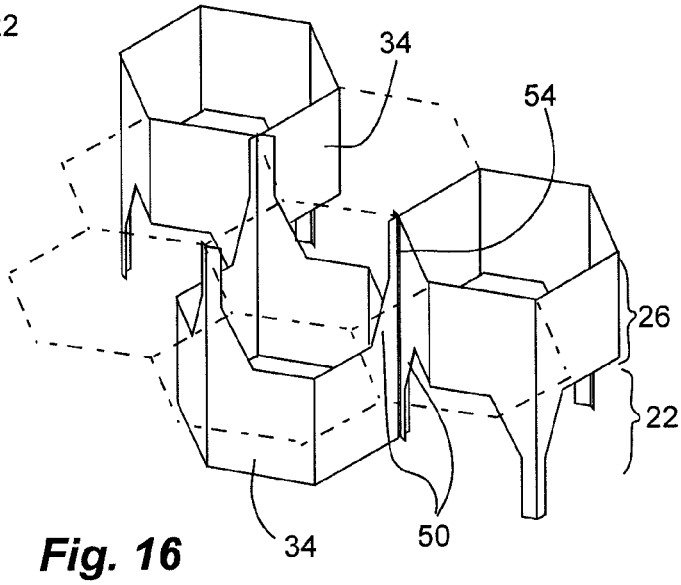
FIG. 16 is a partial perspective schematic view of the portion of the cushion of FIG. 1 showing select walls and cells with various walls and cells removed.

Referring to FIGS. 15-17, in the case of a hexagonal honeycomb pattern, the extending portions 50 can be formed in alternating corners of the hexagon cell, such that three separated corners of the cell can have the extending portions 50 extending into the cell or opening of the other layer. Likewise, the other layer can have a matching configuration with the extending portions 50 of the pair of layers 22 and 26 aligned at the common intersection 54. It can be seen that the walls 34 of the two patterns share a common edge or intersection 54 that are aligned or are collinear. The other alternating corners of the hexagon, without the extending portions, can align with the openings in the other layer. It can be seen that the pair of layers 22 and 26 have been defined by the walls 34, but that the extending portions 50, or thus a portion of each layer, extend into the other layer so that the layers can be said to overlap or intermesh. The openings 42 in layer abut to the walls 34 of the bordering layer.

Referring again to FIGS. 1-17, as described above, the walls 34 are flexible, or formed of a flexible material such as an elastomer gel, to buckle into the openings 42 of the cells 38 under a compressive force. Thus, the walls and the dual layer offset honeycomb provide a cushion effect to a user. In addition, the walls are resilient to return to an original upstanding orientation upon removal of the compressive force. Furthermore, the walls have at least a strength to be self-supporting and maintain the upright orientation of the walls, openings and cells. The material forming the walls can have a density less than or equal to water so that the layers have at least a neutral buoyancy to facilitate maintaining the position of the mat in the bathtub when filled with water.

As described above, the third or top layer 30 is contiguous with the walls 34 of the intermediate layer 26, or layer beneath the top layer. The third or top layer 30 is different than the pair of layers 22 and 26. The third or top layer 30 can provide a greater surface area than the other pair of layers to form more of a surface for receiving the user. A plurality of openings 58 are formed in the third or top layer 30. The openings 58 correspond to the walls 34 of the lower layer 22, or an opposite layer of the pair of layers opposite the third layer, as shown in FIG. 9. Thus, the third or top layer 30 can be a partially continuous layer contiguous with and covering the walls 34 of the intermediate layer 26. The third or top layer 30 can extend over the openings 42 of the intermediate layer 26 without covering the walls 34 of the opposite or lower layer 22. The partially continuous layer can be formed by discrete interconnected facets or petals 62 that extend over the openings 42 of the adjacent layer 26, while exposing the walls 34 of the opposite layer 22. In addition, adjacent or bordering facets 62 can form tabs 66 and can cover a majority of the openings 42 of the opposite layer 22. The tabs 66 and/or adjacent facets 62 can have an outer domed surface 70. The domed surface, and interconnected openings between the layers, can facilitate the runoff of water when the bathtub is drained so that water does not pool on the cushion or mat. In addition, the tabs 66 and/or adjacent facets 62 can have curved edges 72 extending from the top surface to the bottom. The curved edges allow a user to more easily slide or move on the top surface without catching the edges of the tabs or facets. The third or top layer can have a greater surface area in a plane perpendicular to the walls of the pair of layers than is presented by the walls, or cross-sections thereof, to provide a broader surface to receive a user. The third or top layer 30 can be formed of the same elastomer gel material as the walls 34. In addition, all three layers 22, 26 and 30 can be formed together as a continuous, monolithic structure in a single mold of an injection molding system or process.

The perimeter portion 18 extends around at least a portion of the interior portion 14 or pair of layers 22 and 26 (and the third or top layer 30). As shown in FIG. 14, the perimeter portion 18 can extend entirely around one or more interior portions 14. The perimeter portion 18 can be different that the pair of layers 22 and 26, and the third or top layer 30. In addition, the perimeter portion 18 can be contiguous with the interior portion 14, or the pair of layers 22 and 26 (and the third or top layer 30). The perimeter portion 18 can include a substantially continuous upper layer 74 that is substantially or mostly continuous and constant forming an essentially solid surface. The upper layer 74 can be continuous except for a periodic series of bores or tubes 78, discussed in greater detail below. The upper layer 74 can form the uppermost layer and surface of the perimeter portion 18. In addition, the upper layer 74 can be contiguous with the third or top layer 30. The upper layer 74 can be curved or arcuate, and/or angled, in a plane transverse or perpendicular to the cushion, mat or pair of layers, and can traverse a thickness of the pair of layers. Thus, the upper layer 74 can extend substantially from a bottom of the cushion or mat to a top of the cushion or mat. The upper layer 74 or upper surface thereof can be flush or even with the top layer 30 or top surface thereof. Thus, the top layer and upper layer can facilitate the runoff of water from the cushion or mat without forming pools.

The upper layer 74 of the perimeter portion 18 is supported or carried by a support layer 82 underneath the upper layer. The support layer 82 can be formed by a repeating pattern of upstanding walls forming upstanding cells with upstanding openings between the walls 86, similar to that of the lower or opposite layer 22. The walls 86 can extend from substantially a bottom of the cushion or mat to the upper layer 74. The lower or opposite layer 22, or pattern of walls 34 thereof, can extend beyond the interior portion into the perimeter portion 18 under the upper layer 74. Or the pattern of walls 86 of the support layer 82 (of the perimeter portion 18) can match and be consistent with the walls 34 of the lower layer 22 (of the interior portion 14) to form a continuous and uninterrupted pattern, as seen in FIG. 4. The pattern of walls 34 of the intermediate layer 26 can also extend partially into the perimeter portion 18, also as seen in FIG. 4.

The cushion 10 or mat 8 can also include suction cups 90 coupled to a bottom thereof to secure and maintain the cushion or mat on a surface, such as a bottom and/or side of a bathtub. The suction cups 90 can be integrally formed with the cushion. For example, the suction cups 90 can be disposed on the bottom of the perimeter portion 18 and aligned with the bores or tubes 78. The bores or tubes 78 facilitate molding of the suction cups, and also provide structural support to setting and maintaining suction. Holes 92 can be formed in the bottom of the bores or tubes 78 and above the suction cups to allow water to drain from the tubes, as shown in FIG. 12. Alternatively, the bore or tube can be oversized with respect to the suction cup with a hole in a bottom of the bore or tube adjacent the suction cup. It will be appreciated that suction cups can also be formed on the bottom of the lower layer 22 of the interior portion 14. The suctions cups are an example of one means for securing the pair of layers to a surface. Other examples include magnet, weights, etc.

As discussed above, the walls can be formed of an elastomer gel. The entire cushion or mat can be formed of the elastomer gel as a single, continuous piece formed together in a single mold. The entire cushion or mat can have a density less than or equal to water so that the layers have at least a neutral buoyancy to facilitate maintaining the position of the mat in the bathtub when filled with water. The walls 34 can have a notch or channel 94 formed therein to facilitate draining of water from the cells or openings.

Figure 13:
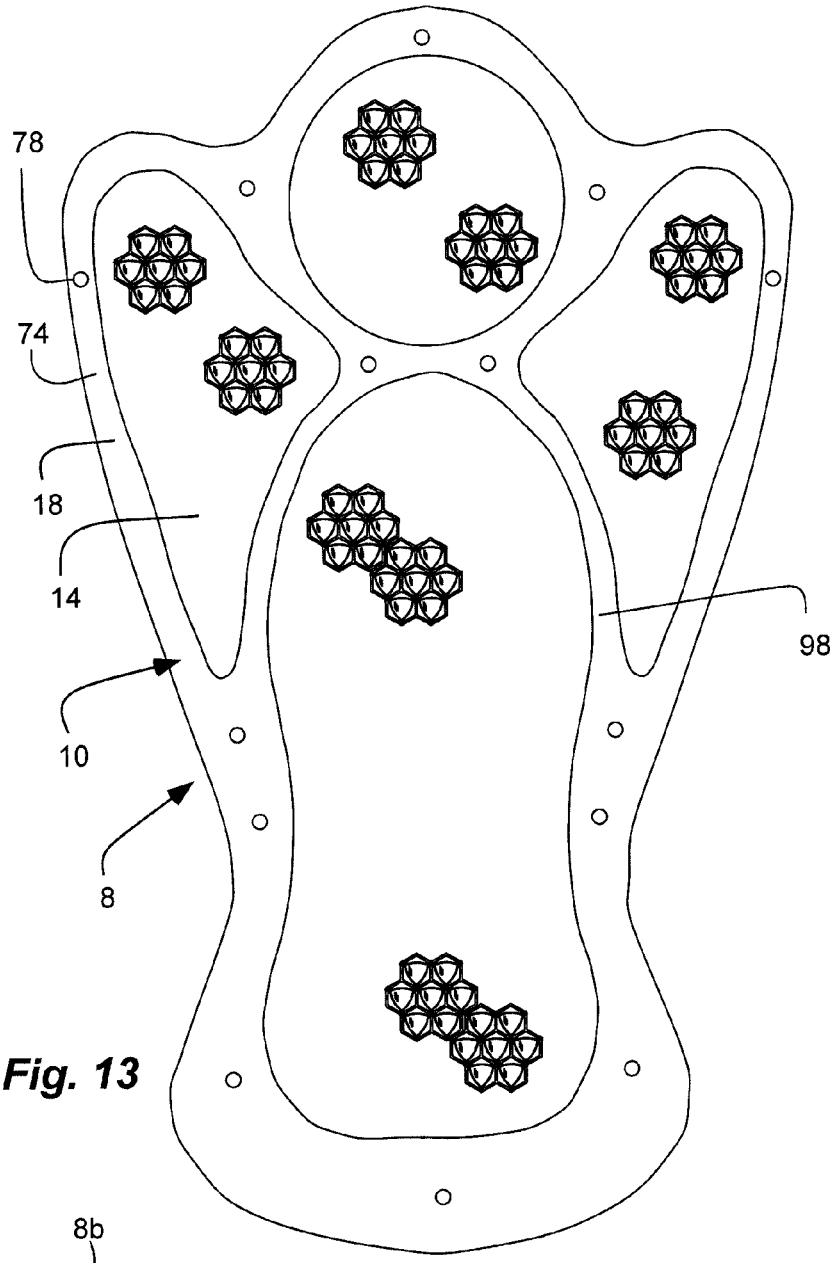
FIG. 13 is a top view of a bathtub mat utilizing the portion of the cushion of FIG. 1, or from which the portion of the cushion is taken, and with the pattern of the cushion of the interior portions shown only partially.
Figure 14:
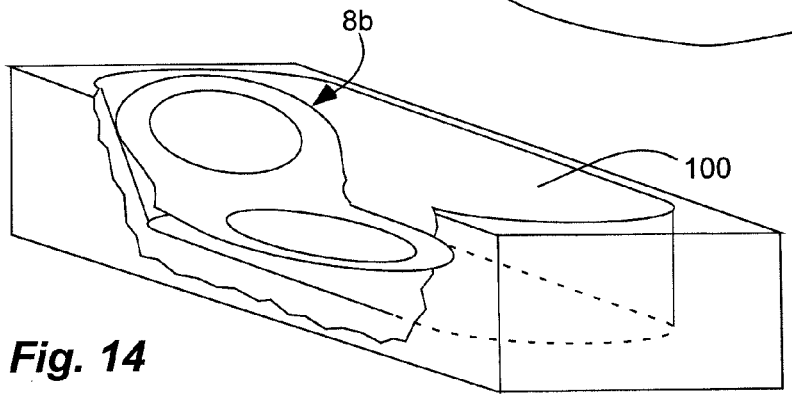
FIG. 14 is a partially cut away perspective schematic view of a bathtub with a bathtub mat utilizing the portion of the cushion of FIG. 1.

Referring to FIG. 13, a bathtub mat 8 is shown with a plurality of interior portion 14 surrounded by an interior portion 18 as described above. In addition, interior partitions 98 can separate the interior portion 14. The interior partitions 98 can be similar to the perimeter or perimeter portion 18 described above, but with the upper surface flat and flush with the upper or top layer 30 of the interior portions, and supported by walls as described above. The interior portions 14 can form head, opposite shoulder and torso portions, as shown.

Referring to FIG. 14, a bathtub mat **8*b* similar to the bathtub mat 8 described above with the cushion portion 10 described above is shown in use with a bathtub 100. The mat 8*b* with the cushion is placed in the bathtub 100** with the opposite layer disposed on a bottom, a side, or both of the bathtub. Water is introduced into the bathtub, and fills the bathtub and surrounds the pair of layers, and fills the openings of the cells. The user or bather can lay in the water in the bathtub and on the mat or cushion. After use, the bathtub can be drained with the water draining off the top layer and through the openings.

All three layers, the pair of layers (lower and intermediate), and/or the top and intermediate layers can be integrally formed with material continuous between the layers. The three layers can be formed together in a mold by injection molding. In addition, the three layers in the interior portion and the perimeter can be formed together in a mold by injection molding.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A cushion device, comprising:

a) a pair of contiguous layers each with a repeating pattern of upstanding straight walls forming upstanding cells with upstanding openings between the walls;

b) the repeating patterns of the pair of layers being laterally offset with respect to one another;

c) the openings in the pair of layers being open with respect to each other to form common openings through the pair of layers;

d) the cells of the pair of layers being commonly oriented;

e) the walls of one of the pair of layers extending into the openings of the cells of the other of the pair of layers; and f) the walls being flexible to buckle into the openings of the cells under a compressive force and resilient to return to an original upstanding orientation, the walls having at least a strength to be self-supporting.

2. A device in accordance with claim 1, further comprising:

a) a third layer contiguous with the walls of an intermediate layer of the pair of layers; and b) a plurality of openings formed in the third layer aligned with the walls of an opposite layer of the pair of layers opposite the third layer.

3. A device in accordance with claim 2, wherein the third layer is a partially continuous layer contiguous with and covering the walls of the intermediate layer, and extending over the openings of the intermediate layer without covering the walls of the opposite layer.

4. A device in accordance with claim 2, wherein the third layer comprises discrete interconnected facets with an outer domed surface.

5. A device in accordance with claim 2, wherein the third layer comprises discrete interconnected facets covering a majority of the openings in cells in the opposite layer.

6. A device in accordance with claim 2, further comprising:

a) a perimeter portion extending around at least a portion of the pair of layers;

b) the perimeter portion having a substantially continuous layer contiguous with the third layer and traversing a thickness of the pair of layers; and c) the opposite layer extending into the perimeter portion with the walls of the opposite layer extending to the substantially continuous layer.

7. A device in accordance with claim 1, further comprising:

a) a perimeter layer extending around at least a portion of the pair of layers; and b) the perimeter layer having a substantially continuous upper layer oriented transverse to a thickness of the pair of layers.

8. A device in accordance with claim 7, wherein the perimeter layer further comprises:

a support layer supporting the substantially continuous layer with a repeating pattern of upstanding walls forming upstanding cells with upstanding openings between the walls.

9. A device in accordance with claim 1, wherein the walls are formed of a material with a density less than or equal to water so that the layers have at least a neutral buoyancy.

10. A device in accordance with claim 9, further comprising means for securing the pair of layers to a surface.

11. A device in accordance with claim 1, wherein the walls are formed of an elastomer gel.

12. A device in accordance with claim 1, wherein the repeating pattern of upstanding walls forms a honeycomb pattern with hexagonal cells.

13. A device in accordance with claim 1, wherein the pair of layers forms a dual layer offset honeycomb.

14. A device in accordance with claim 1, wherein the repeating pattern of upstanding walls forms a honeycomb with cell shapes selected from the group consisting of: square, rectangular, triangle, hexagon, octagon, circular, wavy, and combinations thereof.

15. A device in accordance with claim 1 in combination with a bathtub: comprising:

a) the opposite layer disposed on a bottom, a side, or both of the bathtub; and b) water filling the bathtub and surrounding the pair of layers and filling the openings of the cells.

16. A cushion device, comprising:

a) a pair of contiguous layers including an intermediate layer and a lower layer, each with a repeating pattern of upstanding straight walls forming upstanding cells with upstanding openings between the walls;

b) the repeating patterns of the pair of layers being laterally offset with respect to one another so that the pair of layers form a dual layer offset honeycomb;

c) the openings in the pair of layers being open with respect to each other to form common openings through the pair of layers;

d) the cells of the pair of layers being commonly oriented;

e) the walls of one of the pair of layers extending into the openings of the cells of the other of the pair of layers;

f) the walls being flexible to buckle into the openings of the cells under a compressive force and resilient to return to an original upstanding orientation, the walls having at least a strength to be self-supporting;

g) a top layer contiguous with the walls of the intermediate layer;

h) a plurality of openings formed in the top layer aligned with the walls of the lower layer;

i) a perimeter portion extending around at least a portion of the pair of layers;

j) the perimeter portion having a substantially continuous layer contiguous with the top layer and traversing a thickness of the pair of layers;

k) the lower layer extending into the perimeter portion with the walls of the lower layer extending to the substantially continuous layer;

l) the walls being formed of an elastomer gel with a density less than or equal to water so that the layers have at least a neutral buoyancy; and m) suction cups coupled to the lower layer to secure the pair of layers to a surface.

17. A method for providing a cushion device in accordance with claim 16, comprising:

a) placing the cushion device in a bathtub with the lower layer adjacent a bottom, a side, or both of the bathtub;

b) introducing water into the bathtub; and c) laying in the water in the bathtub and on the cushion device.

18. A cushion device, comprising:

a) a pair of contiguous layers each with a repeating pattern of upstanding straight walls forming upstanding cells with upstanding openings between the walls;

b) the repeating patterns of the pair of layers being laterally offset with respect to one another; and c) the walls of one of the pair of layers extending into the openings of the cells of the other of the pair of layers; and d) the walls being flexible to buckle into the openings of the cells under a compressive force and resilient to return to an original upstanding orientation, the walls having at least a strength to be self-supporting.

19. A device in accordance with claim 18, further comprising:

a) a top layer contiguous with the walls of one of the pair of layers; and b a plurality of openings formed in the top layer aligned with the walls of an opposite layer of the pair of layers opposite the top layer.

20. A device in accordance with claim 18, further comprising:

a) a perimeter layer extending around at least a portion of the pair of layers; and b) the perimeter layer having a substantially continuous upper layer oriented transverse to a thickness of the pair of layers.

* * * * *